United States Patent [19]

Sagefors

[11] Patent Number: 4,725,164

[45] Date of Patent: Feb. 16, 1988

[54] METHOD OF EXCAVATING A STORAGE COMPLEX IN ROCK FOR STORING RADIOACTIVE WASTE

[75] Inventor: Karl I. Sagefors, Stockholm, Sweden

[73] Assignee: Boliden Aktiebolag, Stockholm, Sweden

[21] Appl. No.: 839,904

[22] Filed: Mar. 14, 1986

[30] Foreign Application Priority Data

Apr. 2, 1985 [SE] Sweden ..... 8501647

[51] Int. Cl.[4] ..... G21F 9/24

[52] U.S. Cl. ..... 405/128; 252/633

[58] Field of Search ..... 405/55, 128, 53, 55; 252/633

[56] References Cited

U.S. PATENT DOCUMENTS 4,192,629 3/1980 Hallenius et al. ..... 405/128
4,326,820 4/1982 Uerpmann et al. ..... 405/128

FOREIGN PATENT DOCUMENTS 7613996-2 6/1978 Sweden .
7707639-6 1/1981 Sweden .
7700552-8 10/1981 Sweden .
7702310-9 10/1981 Sweden .
8305025-2 3/1985 Sweden .

OTHER PUBLICATIONS 8401994-2 (Boliden AB) 10/85.
83/00526 (KI Sagefors) 2/83.

*Primary Examiner*—David H. Corbin
*Attorney, Agent, or Firm*—Brumbaugh, Graves, Donohue & Raymond

[57] ABSTRACT

The present invention relates to a method of excavating a storage complex in rock for storing radioactive material, or other harmful material. The complex to which the method relates comprises a hollow body which is formed from a solid material and the interior of which constitutes a storage space for the radioactive material or other harmful material to be stored. The hollow body is located in an inner cavity (4) which is excavated from the rock and which has larger dimensions than the hollow body. The hollow body is spaced from the outer walls of the inner cavity (4) such as to leave a space which is filled with an elastoplastic, deformable material. At least one vertical shaft (2) is driven partially through the location of the space (4), and the space is excavated from the bottom of the shaft (2) and upwards, while filling the space or cavity (4) thus formed substantially at the same time as the cavity is formed.

8 Claims, 7 Drawing Figures

METHOD OF EXCAVATING A STORAGE COMPLEX IN ROCK FOR STORING RADIOACTIVE WASTE

DESCRIPTION

1. Technical Field

The present invention relates to a method of excavating a complex in rock for storing radioactive material. The storage complex comprises a hollow body which is formed from a solid material, preferably rock, and the interior of which provides storage space for the radioactive material. The solid body is located in an internal, rock cavity the dimensions of which are larger than those of the hollow body. The body is spaced from the outer walls of the inner cavity and the space defined between the mutually facing surfaces of the hollow body and the outer walls of the cavity is intended to be filled with an elastoplastic, deformable material.

The object of the present invention is to provide a possiblity of preparing such a plant in a manner which will enable the number of tunnels, and then particularly the horizontal tunnels joining the cavity, to be restricted to the smallest number possible while still providing a storage plant which is fully effective in practice.

2. Background Prior Art

The concept of storing radioactive waste in storage facilities embodied in rock is described generally, inter alia, in SE-A-7613996-3; SE-A-7700552-8; SE-A-7702310-9; SE-A-7707639-6; SE-A-8305025-2and SE-A-8401994-2, of which the two latter documents were not available to the public at the time of filling the present invention. The concept has been discussed under the reference WP-Cave, as a solution to the terminal storage of radioactive waste deriving, inter alia, from nuclear reactors. In general technical terms a WP-Cave comprises an internal hollow body into which the actual radioactive material is introduced and stored, either over a limited time period or terminally. In this latter case, the tunnels providing access to the hollow body are ultimately sealed-off totally, after a given period of time has lapsed. The hollow body preferably comprises part of the rock in which the plant is founded, and is spaced from the surrounding rock by a slot or annular cavity formed in the rock, externally of and around the hollow body. As before mentioned, this annular slot or cavity is filled with an elastoplastic, deformable material, preferably clay, such as bentonite, suitably the latter, capable of swelling and sealing the rock against water running or migrating towards the hollow body. One concept of forming the annular cavity/shot around the hollow body involves the initial preparation of a helical tunnel extending externally along the whole of the storage plant, and the subsequent formation of horizontal access tunnels at suitable, recurrent levels extending from the helical tunnel into the region of the cavity, for the purpose of blasting the cavity and removing the debris or shot rock through the horizontal access tunnels and out through the helical tunnel. This method enables the cavity to be formed in an extremely effective and efficient manner, since the shot rock can be loaded onto the transport vehicles on the blasting site, and the vehicles shuttled backwards and forwards in the helical tunnel. One drawback with this method, however, is the large number of horizontal access tunnels entailed. It is the intention to fill-in these tunnels upon completion of the plant.

With respect to the water present in the surroundings, however, calculations have shown that the tunnels are much to short to provide, when filled, a seal which can be guaranted to endure the passage of time when effected with present day techniques. Neither is there known at present a material which will endure the ravages of "infinite" time, and consequently there remains the possiblity of water, and possibly also of radioactive material, leaking through a seal when it is effected in accordance with the aforesaid technique. In view of this it has been demanded that other ways of creating such a seal are found. Accordingly, it has been proposed to incorporate annular elements filled with bentonite at right angles to the longitudinal axis of respective tunnels; or to fill the access tunnels with compressed bentonite blocks in layers of great widths; or to inject a bentonite suspension into the rock around the tunnels as a shield against hydraulic pressure, and therewith enable the tunnels to be used as water ducts. Although it is possible that these methods may prove suitable, it is difficult to guarantee that the material which it is proposed to use will remain resistant and durable throughout the long periods of time involved.

DISCLOSURE OF THE PRESENT INVENTION

It has been surprisingly found possible to eliminate these problems by means of the present invention, which greatly reduces the need for access tunnels. The invention is characterized by creating at least one vertical shaft which extends at least partially through the ultimate location of the aforesaid cavity; by excavating said cavity from the rock, beginning from the bottom of the shaft and upwards; and by filling the cavity with an elastoplastic deformable material substantially at the same time as the cavity is formed.

When proceeding in accordance with the invention there is obtained a much higher degree of safety against the ingress of water and/or the egress of contaminated material/gas than could be expected from the sole expedient of omitting the access tunnels themselves. The vertical ducts would seem to afford a better restriction than could be generally expected with an inclined helical transport tunnel.

The invention will now be described in more detail with reference to the accompanying drawings, in which FIG. 1 illustrates a plant constructed in accordance with the invention;

Figure 1:
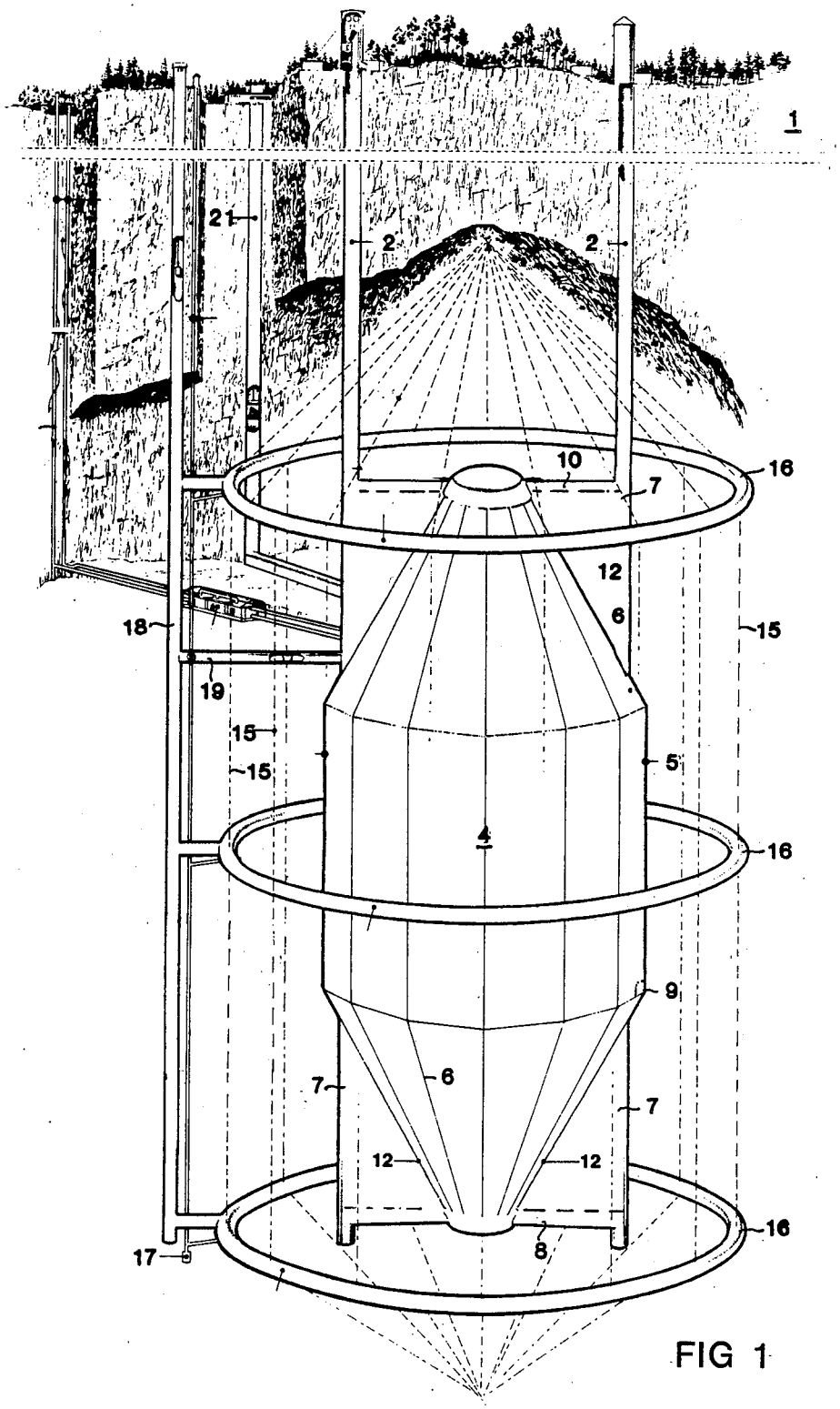

In FIG. 1 the reference 1 designates the ground surface from which two vertical shafts 2 are driven to a depth of 500 m in the underlying bedrock. The shafts 2 are placed diametrically opposite one another on a respective side of an imaginary circle. An annular cavity or slot 4 is excavated from the bedrock at a depth of 200–500 m in a manner hereinafter described, this cavity having the form of an upstanding circular cylinder 5 terminated by conically tapering end sections 6. The cavity 4 has an overall width of 3–20 m. In the case of waste of low or medium radioactivity, the width of the slot/cavity 4 may be in the order of 1 m or more. Located between the two vertical shafts 2 and the end pieces 6 are vertically and radially extending slots 7, which have a width which is at least equal to that of the shafts 2. The slots 7 extend down to the bottom level of the shaft and to its top level width respective to the location of the cavity.

A storage space (not shown) is formed in the rock located inwardly of and defined by the cavity 4. The interior design and construction of the storage space can vary in accordance with the kind of storage and/or activity concerned. One such storage space is illustrated and described in SE-A-8401994-2; a further storage space is illustrated and described in SE-A-7613996-3; and another in SE-A-8305025-2. The internal design and construction of the storage space, however, is not the subject of this invention, and any suitable storage space can be provided in the rock mass, this storage space here being designated the hollow body.

Figure 2:
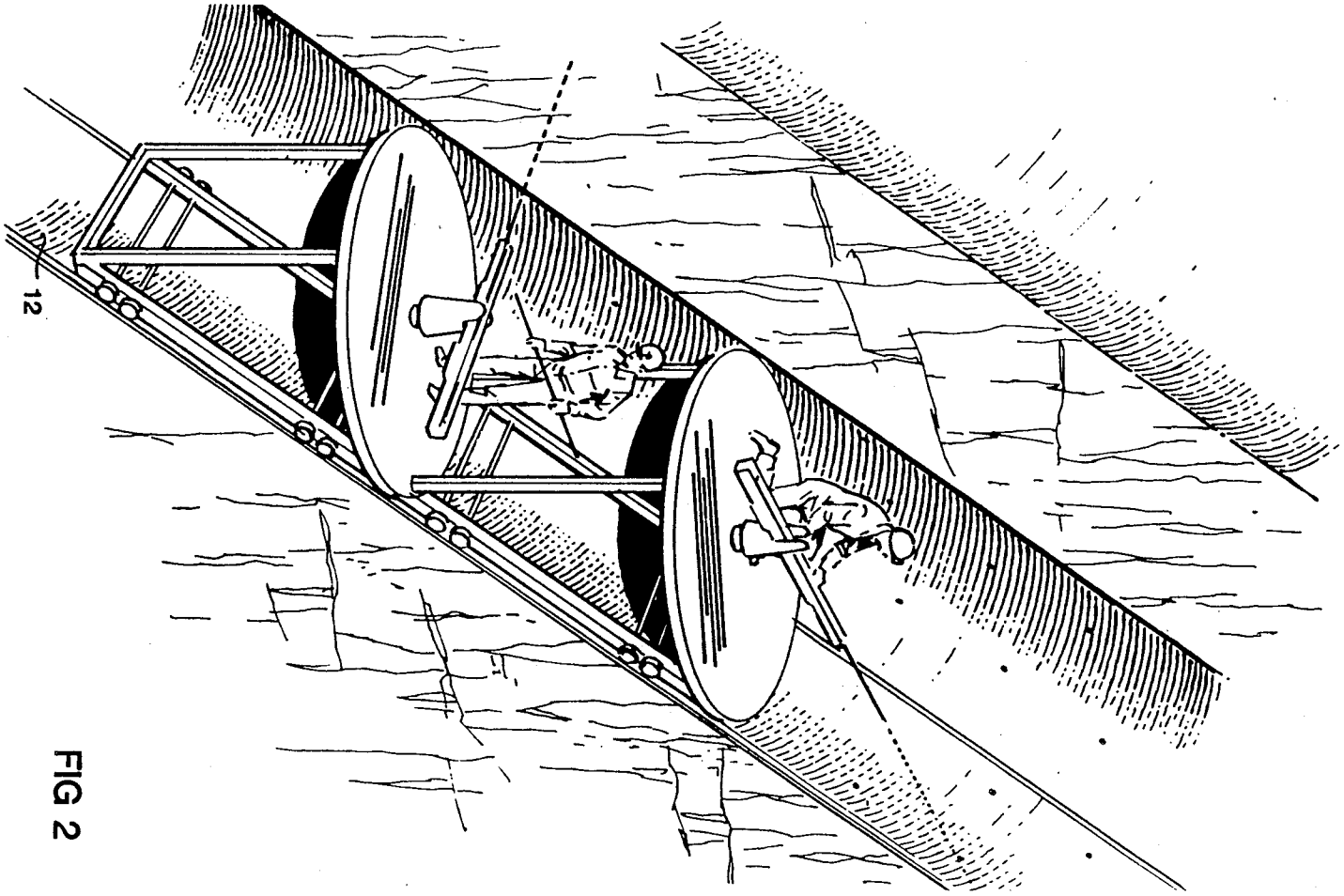
FIG. 2 illustrates the performance of a working operation carried out in an inclined auxiliary shaft.
Figure 3:
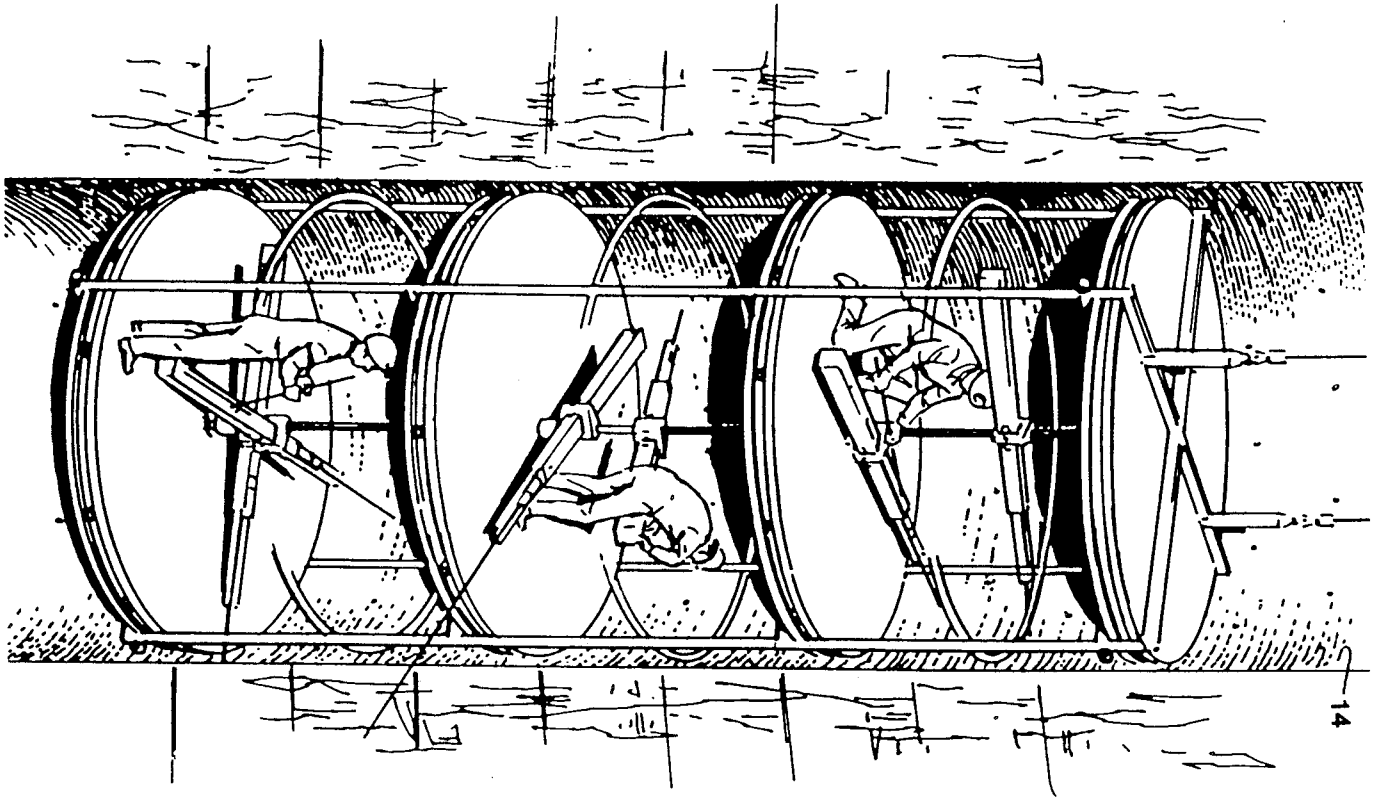
FIG. 3 illustrates the performance of a working operation in a vertical shaft.
Figure 5:
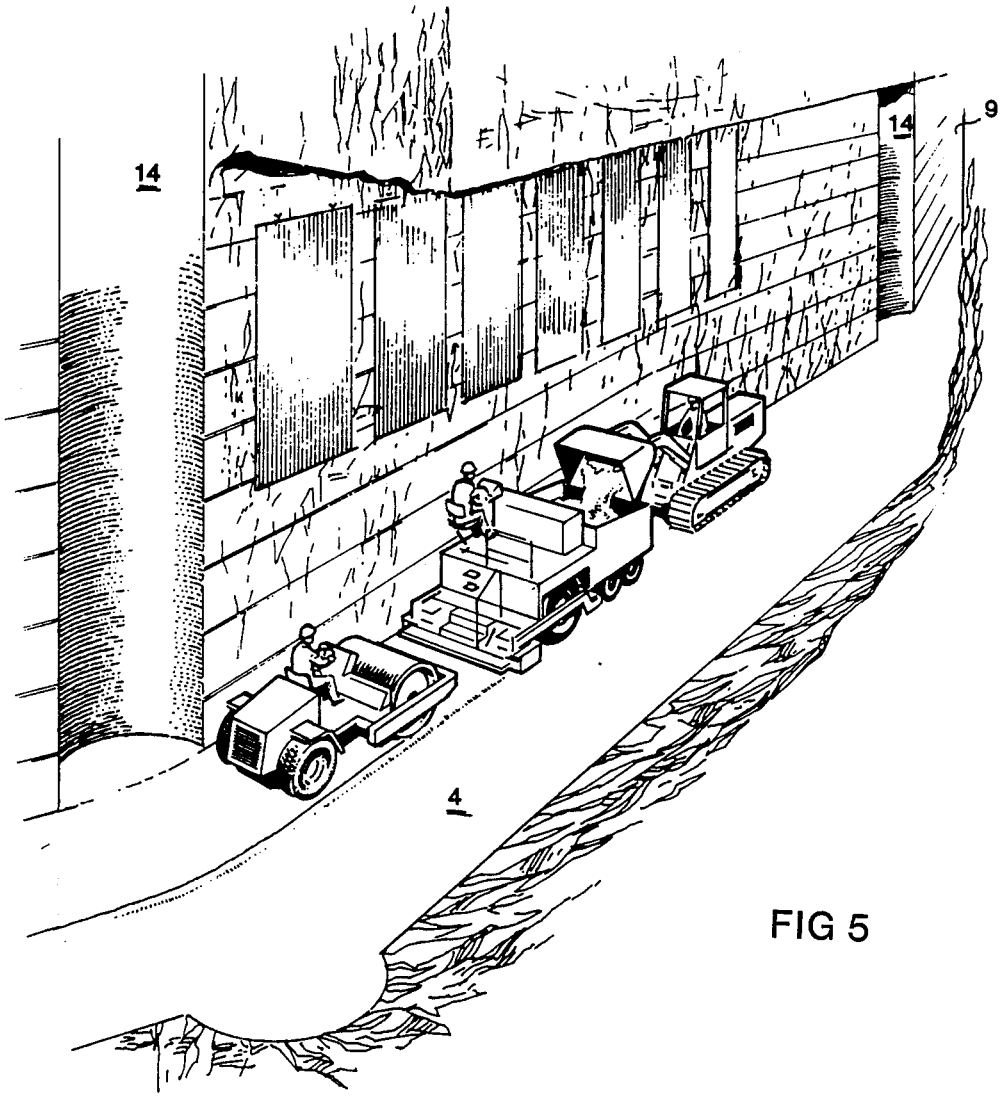
FIG. 5 illustrates filling of the cavity with an elastoplastic, deformable material.

Excavation of the cavity 4 is commenced with the driving of the vertical shafts 2. Lift baskets or cages 11 are then installed in the shafts 2, for the hoisting of shot rock and lowerinag of elastoplastic, deformable material with which the cavity 4 is re-filled. Two horizontal tunnels 8 are excavated from the bottom of respective shafts 2 in towards the centre of the bottom level of the storage plant. A circular chamber is then excavated at this bottom level. Annular tunnels 9 are formed on the levels of the vertical cylindrical part of the plant. Similarly, two horizontal tunnels 10 which extend into the top level of the plant are formed in the same manner as with the bottom level. A plurality of oblique or slanting driving benches or adits 12 are formed with the aid of, for example, full-face boring techniques. The rock mass is drilled laterally from these driving adits 12 (FIG. 2) towards adjacent adits 12 for the purpose of blasting and excavating the lower conical part of the cavity 4. The shot rock is transported to the shafts 2, in which a dump-container 13 is arranged for vertical movement. The slots 7 are driven and blasted at the same time as the conical part of the cavity 4, and constitute therewith transport routes between the conical part of the cavity 4 and the shafts 2. Subsequent to excavating a given section of the rock mass (10 m), elastoplastic, deformable material is distributed throughout and packed into the cavity 4 thus formed, with the aid of the lift or a similar rock pass (FIG. 5). A vertical driving shaft 14 is formed between the annular tunnels 9 in the same manner as that described above. When final driving of the cavity 4 has reached the upper annular tunnel 9, oblique driving adits 12 are again driven to the top level. FIG. 3 illustrates the drilling of bores for blasting the cavity 4 between adjacent vertical driving shafts 14.

Figure 4:
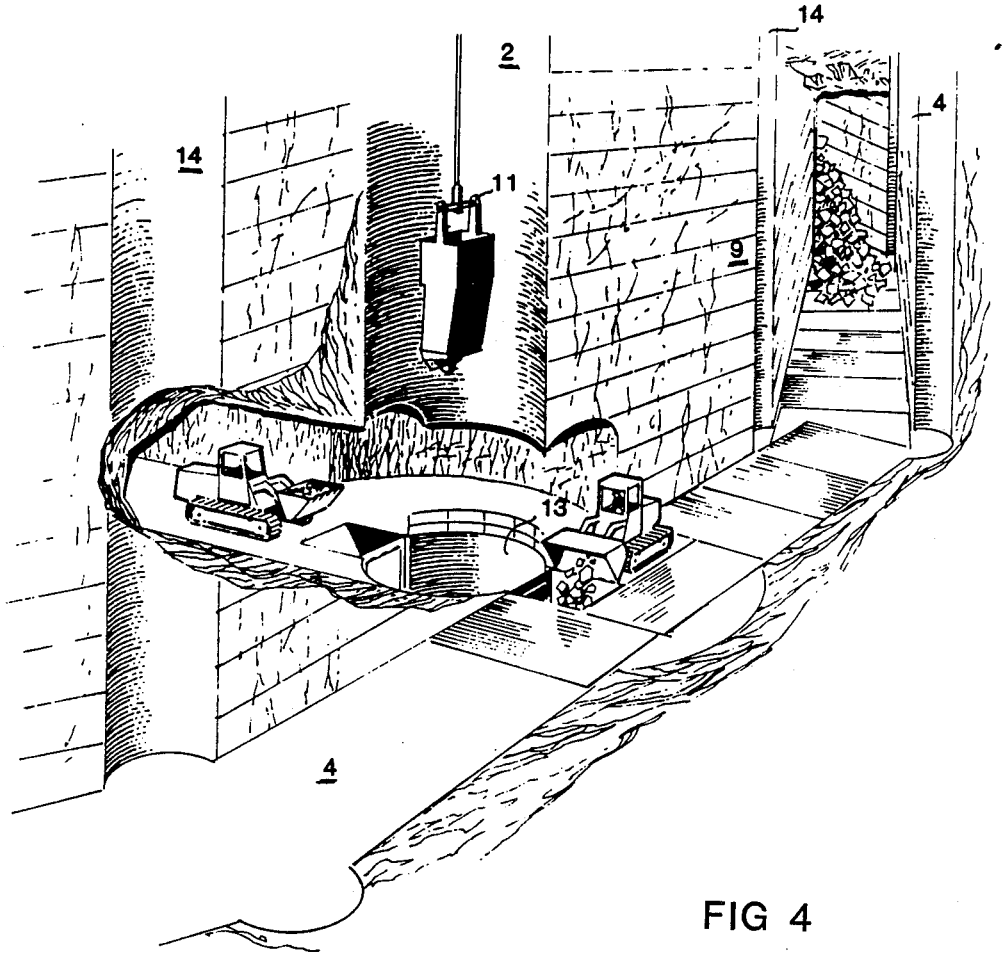
FIG. 4 illustrates the removal of shot rock from the hollow body and from the cavity.

FIG. 4 illustrates the dumping of shot rock-mass, the shot rock shown in FIG. 4 deriving partly from the excavation of the hollow body and partly from excavation of the cavity 4. The shot rock is transported by truck to the dumping container 13, into which the hoist basket or bucket 11 is lowered and automatically filled. When excavating the rock-mass and transporting the shot rock to the hoist basket, the elastoplastic, deformable material is shielded with steel plates, partly to facilitate the work of the transporting and loading machines, and partly to guarantee the homogenity of the deformable material, preferably bentonite.

As before mentioned, the procedure of filling the cavity 4 with bentonite is illustrated in FIG. 5, which shows the aforesaid steel plates mounted on the rock face while this work is being carried out.

Figure 6:
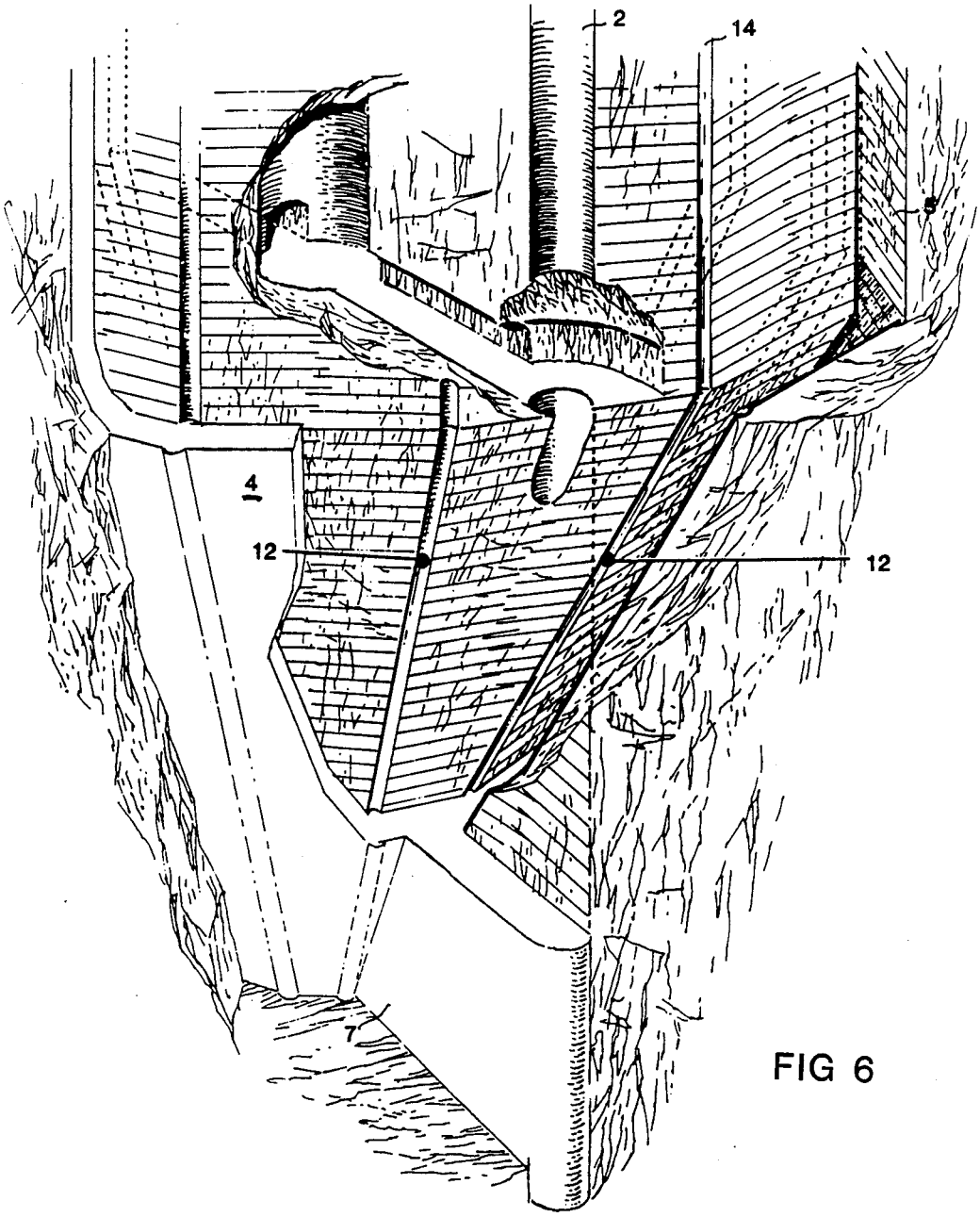
FIG. 6 illustrates the geometry of the excavated cavity.
Figure 7:
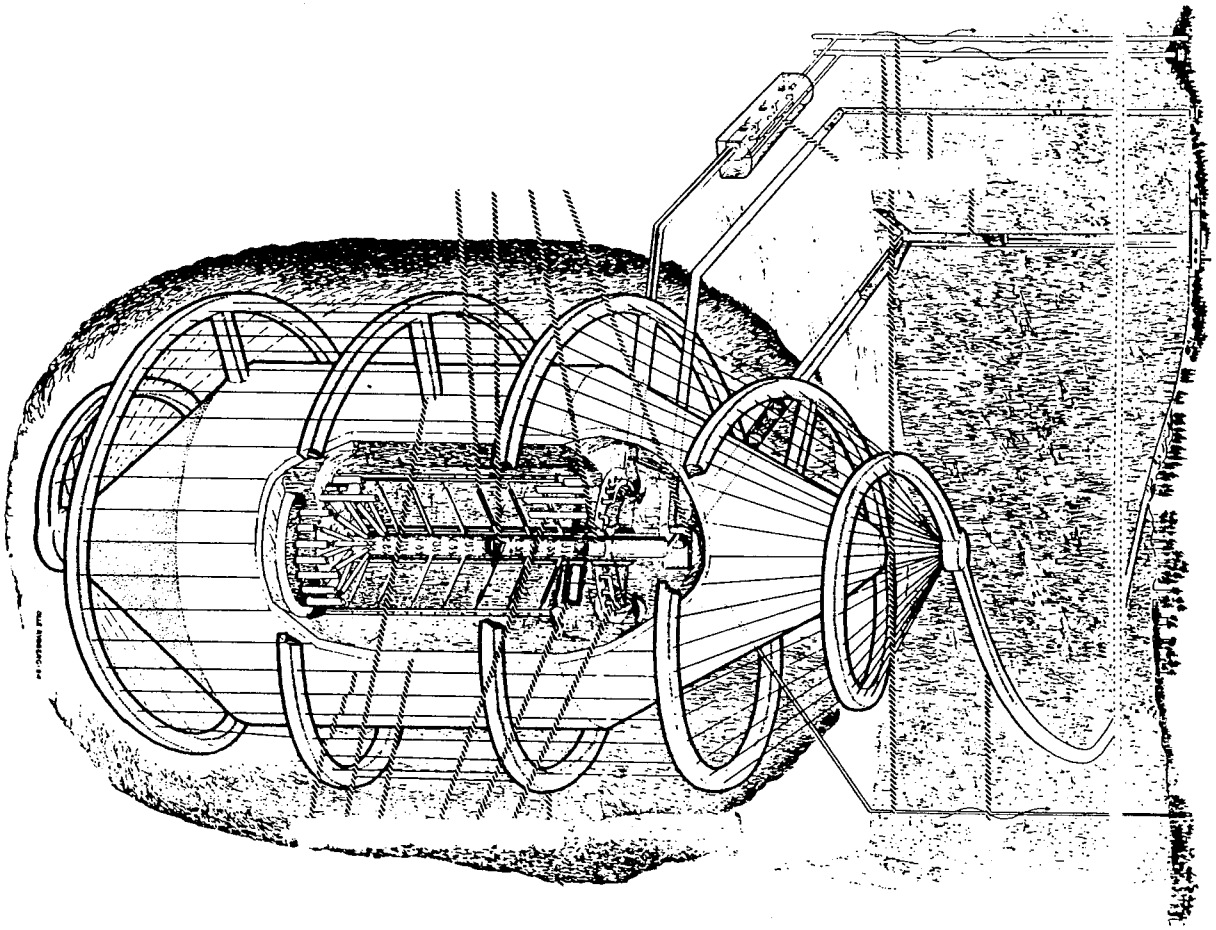
FIG. 7 illustrates a plant constructed in accordance with known techniques with regard to a bentonite shield.

FIG. 6 illustrates the geometry of the bentonite-filled cavity. Both FIG. 6 and FIG. 4 illustrate removal of the shot rock obtained when blasting the storage space (not shown) in the hollow body, through horizontal tunnels at the bottom level of the storage space.

FIG. 1 also illustrates the arrangement of a so-called hydraulic cage around the plant. In this respect, at least two but preferably more, three in FIG. 1, horizontal annular tunnels 16 are excavated or driven externally of the bentonite shield, the cavity 4. A large number of vertical bores 15 are drilled between the horizontal annular tunnels 16, at a centre-to-centre distance of 1½–2 m apart, these vertical boreholes 15 (shown in broken lines in FIG. 1) being collected at points above the top and beneath the bottom of the plant. The boreholes function as conduits for draining-off water which enters the construction site over the period during which construction work is carried out and during monotoring periods, this water being collected at the bottom of the plant and pumped away via a pumping station 17.

Construction of the hydraulic cage can be effected quite independently of the construction of the remainder of the plant.

As illustrated in FIG. 1, a vertical shaft 18 is used in the construction of the hydraulic cage for introducing various equipment into the construction site and the removal of shot rock therefrom is also used as an access tunnel or adit 19 to an upper slot 7. Ventilation conduits 20 are also drawn through the slots 7, for ventilation of the interior of the plant during its construction and during filling of the cavity 4. A service shaft 21 for servicing the storage space extends partially vertically and partially horizontally in the form of a tunnel in the vicinity of the top level of the storage space.

The cavity 4 can be formed and filled with bentonite in the aforesaid manner with the minimum of connecting and/or through-passing access tunnels.

The number of shafts 2 can be varied according to the size of the storage space provided, and may range from 1–5, preferably 2–3. The shafts 2 may also be driven radially internally of the cavity 4, or externally thereof as desired. The shafts may even be driven at some distance from the cavity 4 and connected therewith through a vertical slot, e.g. a modification of the slot 7.

What is claimed is:

1. A method for excavating a storage complex in rock for storing radioactive waste comprising:

forming a hollow body from solid material, the interior of which defines a storage area for the radioactive waste, forming a cavity in the rock, said cavity having dimensions larger than said hollow body and formed in such a manner so as to create a space between said hollow body and the outer boundaries of said cavity, wherein said cavity is formed by driving at least one vertical shaft into the rock and excavating said cavity upwards from the bottom of said shaft, and filling said space between said hollow body and the outer boundaries of said cavity with an elastoplastic, deformable material substantially at the same time said cavity is formed.

2. A method according to claim 1 further comprising:

forming a hydraulic cage around said space by interconnecting at least two mutually spaced horizontally extending annular tunnels by means of a plurality of vertical bore holes disposed between said annular tunnels and collected at points above the top and below the bottom surfaces of said cavity.

3. A method according to claim 1 wherein said cavity is formed by excavating two vertical shafts into the rock.

4. A method according to claim 1 wherein said cavity is in the form of a central vertical, circular cylinder having conically tapered end parts at the upper and lower ends thereof and said vertical shaft extends partially through the space between the hollow body and the outer boundaries of said cavity.

5. A method according to claim 3 wherein said cavity is in the form of a central vertical, circular cylinder having conically tapered end parts at the upper and lower ends thereof and said vertical shaft extends partially through the location where said cavity is to be excavated.

6. A method according to claim 4 further comprising:

driving said shaft substantially through said vertical cylindrical portion of said cavity, extending said shaft above and below said cylindrical portion and excavating a plurality of vertical slots between said conical tapered ends of said cavity and said shaft, and filling said vertical slots with an elastoplastic, deformable material.

7. A method according to claim 6 further comprising:

driving said shafts substantially through said vertical cylindrical portion of said cavity, extending said shafts above and below said cylindrical portion and excavating a plurality of vertical slots between said conical tapered ends of said cavity and said shafts, and filling said vertical slots with an elastoplastic, deformable material.

8. A method according to claim 6 or 7 further comprising:

forming a plurality of service tunnels through said vertical slots for serving said storage complex during its preparation and operation.

* * * * *

UNITED STATES PATENT AND TRADEMARK OFFICE

CERTIFICATE OF CORRECTION

PATENT NO. : 4,725,164

DATED : February 16, 1988

INVENTOR(S) : Karl I. Sagefors

It is certified that error appears in the above-identified patent and that said Letters Patent is hereby corrected as shown below:

Col. 1, line 52, "cavity/shot" should read --cavity/slot--.

Col. 2, line 3, "to short" should be --too short--;

line 4, "guaranted" should be --guaranteed--.

Col. 3, line 26, "lowerinag" should read --lowering--.

Col. 4, line 23, "monotoring" should be --monitoring--;

line 29, after "18" delete --is--.

Col. 6, line 9, "claim 6" should read --claim 5--.

Signed and Sealed this

Sixth Day of September, 1988

*Attest:*

DONALD J. QUIGG

*Attesting Officer*

*Commissioner of Patents and Trademarks*